US009705200B2

(12) United States Patent
Zheng et al.

(10) Patent No.: US 9,705,200 B2
(45) Date of Patent: Jul. 11, 2017

(54) TRAVELING-WAVE LOOP ANTENNA BASED ON METAL RING CAVITY FOR GENERATING RADIO FREQUENCY ORBITAL ANGULAR MOMENTUM

(71) Applicant: ZHEJIANG UNIVERSITY, Hangzhou, Zhejiang (CN)

(72) Inventors: Shilie Zheng, Zhejiang (CN); Xianmin Zhang, Zhejiang (CN); Hao Chi, Zhejiang (CN); Xiaofeng Jin, Zhejiang (CN)

(73) Assignee: ZHEJIANG UNIVERSITY, Hangzhou, Zhejiang (CN)

( * ) Notice: Subject to any disclaimer, the term of this patent is extended or adjusted under 35 U.S.C. 154(b) by 0 days.

(21) Appl. No.: 14/912,404

(22) PCT Filed: Sep. 12, 2014

(86) PCT No.: PCT/CN2014/086334

§ 371 (c)(1),
(2) Date: Feb. 17, 2016

(87) PCT Pub. No.: WO2015/039580

PCT Pub. Date: Mar. 26, 2015

(65) Prior Publication Data

US 2016/0197410 A1 Jul. 7, 2016

(30) Foreign Application Priority Data

Sep. 22, 2013 (CN) ..... 2013 1 0433782

(51) Int. Cl.
*H01Q 13/22* (2006.01)

(52) U.S. Cl.
CPC ..... *H01Q 13/22* (2013.01)

(58) Field of Classification Search
CPC ..... H01Q 13/22
USPC ..... 343/732
See application file for complete search history.

(56) References Cited

FOREIGN PATENT DOCUMENTS

| | | |
|---|---|---|
| CN | 103474776 | 12/2013 |
| JP | 2009206909 | 9/2009 |
| WO | 2005069443 | 7/2005 |

*Primary Examiner* — Dameon E Levi
*Assistant Examiner* — Andrea Lindgren Baltzell

(57) ABSTRACT

A traveling-wave loop antenna based on a metal ring cavity for generating a radio frequency OAM beam includes a main structure which is the metal ring cavity whose top surface has an annular slot circumferentially opened. Two openings, ¼ of a perimeter of the metal ring cavity apart, are two excitation source ports of the antenna, for connecting a metal waveguide. When the two ports are inputted with microwave sources having the same frequency and a phase difference of ±90°, an electromagnetic field in the metal ring cavity exhibits a traveling-wave distribution propagating circumferentially clockwise or counterclockwise. The annular slot constitutes the antenna. A reasonable design of a size of the metal ring cavity and a position of the annular slot realizes a conversion from a microwave guided-wave mode to an OAM mode and a generation of the radio frequency OAM beams with different orders l in free space.

3 Claims, 3 Drawing Sheets

TRAVELING-WAVE LOOP ANTENNA BASED ON METAL RING CAVITY FOR GENERATING RADIO FREQUENCY ORBITAL ANGULAR MOMENTUM

CROSS REFERENCE OF RELATED APPLICATION

This is a U.S. National Stage under 35 U.S.C 371 of the International Application PCT/CN2014/086334, filed Sep. 12, 2014, which claims priority under 35 U.S.C. 119(a-d) to CN 201310433782.3, filed Sep. 22, 2013.

BACKGROUND OF THE PRESENT INVENTION

Field of Invention

The present invention relates to a technical field of orbital angular momentum (OAM) wireless communication, and more particularly to a traveling-wave loop antenna based on a metal ring cavity for generating a radio frequency OAM.

Description of Related Arts

With the global entry into the mobile internet age, the frequency spectrum deficiency in the mobile communication services is increasingly serious. Because the high-quality frequency spectrum resource in the low frequency band is limited, it is difficult to satisfy the demands of the mobile communication merely by dividing the frequency spectrums. Under the circumstance, it is particularly important to develop a technology to increase the frequency spectrum efficiency. Currently, people have made a great number of researches on expanding the information capacity resource based on the frequency spectrum, phase and amplitude of the electromagnetic wave, such as the cognitive radio which is an intelligent wireless communication technology for increasing the frequency spectrum utilization, the high-order coherent signal modulation for increasing the frequency spectrum efficiency of a single carrier, the multi-carrier technology which doubles the frequency spectrum efficiency as compared with the serial system, and the multiple-input multiple-output (MIMO) communication technology for increasing the frequency spectrum efficiency and multiplying the channel capacity. Obviously, the capacity resource based on the freedoms of electromagnetic wave, such as frequency spectrum, phase and amplitude, has been relatively fully developed and utilized. Although a further gradual capacity expansion based on these freedoms is feasible, no enough space exists for expanding the capacity by several orders of magnitude. Thus, it is a great scientific and technical challenge to provide another physical parameter as a new freedom to realize the electromagnetic wave communication technology and satisfy the increasing demands of the communication capacity of several orders of magnitude within the limited frequency spectrum resource. The OAM wireless communication emerges as a response to the challenge.

The electromagnetic wave carries OAM as well as energy. The OAM is a basic physical property of the electromagnetic wave and describes the azimuthal phase distribution of the electromagnetic wave around the propagation direction axis. For an electromagnetic wave at an arbitrary frequency, all the OAM beams constitute a group of eigen modes which are mutually orthogonal to each other and have an infinite number. The OAM communication adopts the OAM order (valued l), which is the eigen modes of the electromagnetic wave, to serve as an unexploited freedom for modulation and multiplexing. In other words, different values of OAM mode l are encoded by different information and represent different communication channels, hence OAM has the ability to further increase the frequency spectrum efficiency. Because of the unbounded range of l, the OAM communication has the potential to infinitely increase the capacity of the information carried by the electromagnetic wave theoretically.

Conventionally, the application of using radio frequency OAM as an unexploited freedom in the wireless communication field is still in the primary stage. Most of the researches thereof are focused on the theoretical analysis. The research and development, on generation and multiplexing of the radio frequency OAM beams and the related devices, is the basis for verifying the free space channel characteristics of the OAM beams and realizing the radio frequency OAM wireless communication system. So far, most of the OAM beam generation methods are originated from the conventional circular antenna array designed by Thide et al. in 2007. However, the order of the OAM beam generated by the conventional method of Thide et al. is limited by the number of the circular loop antenna array. Given that the number of the loop antenna array is N, the order l of the generated OAM beam must be smaller than N/2. Moreover, the conventional method of Thide et al. is disadvantageous for the multiplexing of the OAM beams. Thus, a simple and feasible conversion device based on the mature waveguide technology, which can convert the radio frequency guided-wave mode into the radio frequency OAM mode, shows a great practical significance for accelerating and facilitating the future radio frequency OAM high-speed communication.

SUMMARY OF THE PRESENT INVENTION

The object of the present invention is to provide a traveling-wave loop antenna based on a metal ring cavity for generating a radio frequency OAM beam and a radio frequency OAM beam multiplexing device based on the traveling-wave loop antenna.

Technical solutions of the present invention are described as follows.

The present invention provides a traveling-wave loop antenna based on a metal ring cavity for generating a radio frequency OAM beam. A main structure of the traveling-wave loop antenna is the metal ring cavity whose top surface has an annular slot opened circumferentially. The metal ring cavity is obtained through bending a rectangular waveguide working at a $TE_{10}$ mode. A height of a lateral surface of the metal ring cavity is a wide side a of the rectangular waveguide; a width of the top surface of the metal ring cavity is a narrow side b of the rectangular waveguide; the slot is opened in the middle of the narrow side of the rectangular waveguide; a perimeter of the metal ring cavity is a longitudinal length of the rectangular waveguide; and a circumferential propagation constant $k_\varphi$ of the metal ring cavity is equivalent to a longitudinal propagation constant $k_z$ of the rectangular waveguide. Two openings, which are ¼ of the perimeter apart with each other on the lateral surface of the metal ring cavity, are two excitation source ports, for connecting a metal waveguide. When the two excitation source ports are inputted with microwave sources having the same frequency and a phase difference of ±90°, an electromagnetic field in the metal ring cavity exhibits a traveling-wave distribution propagating circumferentially clockwise or counterclockwise. The traveling-wave loop antenna radiates an electromagnetic wave into free space from the slot opened on the top surface of the metal ring cavity. A size of the metal ring cavity is reasonably designed so that the circumferential propagation constant $k_\phi$ of the metal ring cavity satisfies $k_\phi R=l$, wherein R is a radius of the annular slot, and hence a conversion from a microwave guided-wave mode to an OAM mode and the generation of the OAM beam with order of ±l in free space are realized. The order l is positive or negative is determined by whether the phase difference of the two excitation source ports is +90° or −90°.

Using the metal ring cavity based traveling-wave loop antenna for generating the radio frequency OAM beam provided by the present invention, a radio frequency OAM beam multiplexing device is further provided. For the traveling-wave loop antenna based on the metal ring cavity, in order to generate the OAM beam with the order of l in free space, the circumferential propagation constant $k_\phi$ of the metal ring cavity is required to satisfy $k_\phi R=l$, wherein R is the radius of the annular slot. Given the circumferential propagation constant $k_\phi$ (namely the longitudinal propagation constant $k_z$ of the rectangular waveguide) and the $TE_{10}$ mode, $$k_\varphi = \sqrt{k^2 - \left(\frac{\pi}{a}\right)^2},$$

wherein a is the wide side of the rectangular waveguide and k is a propagation constant in vacuum. Thus, the order l of the OAM beam is related to the wide side of the rectangular waveguide and the radius of the annular slot. The wide side of the rectangular waveguide and the radius of the annular slot are reasonably designed to realize the generation of the OAM beams with the different orders. An integration of a plurality of the metal ring cavities is able to generate the OAM beams with the different orders in free space, so as to realize multiplexing of the radio frequency OAM beams.

Compared with the prior arts, the present invention has following advantages.

As to the great potential of the OAM wireless communication system, the present invention provides the simple and feasible traveling-wave loop antenna based on the metal ring cavity for generating the radio frequency OAM beam, and further provides the radio frequency OAM beam multiplexing device based on the traveling-wave loop antenna. The present invention shows a great significance for establishing the OAM wireless communication system and facilitating a practical use of the OAM wireless communication. Compared with the conventional OAM beam generation method based on the loop antenna array, illustrated in the description of related arts, the present invention is not limited by the number of the antenna array and is able to generate the radio frequency OAM beam having an arbitrary order. Moreover, because the present invention adopts the excitation having the same frequency and the phase difference of 90° into the two ports, it is very easy to satisfy a phase distribution of exp(ilϕ) at the annular slot of the metal ring cavity and form the traveling-wave loop antenna for generating the OAM beam, needless of accurately controlling the phase of each array unit which is necessary in the conventional OAM beam generation method based on the loop antenna array. Furthermore, based on a structure of the traveling-wave loop antenna of the present invention, it is easy to integrate the traveling-wave loop antennas based on the metal ring cavity, for the simultaneous generation of the radio frequency OAM beams with different orders in free space, so as to realize multiplexing of the OAM beams.

These and other objectives, features, and advantages of the present invention will become apparent from the following detailed description, the accompanying drawings, and the appended claims.

DETAILED DESCRIPTION OF THE PREFERRED EMBODIMENT

The present invention is further described with accompanying drawings.

Figure 1:
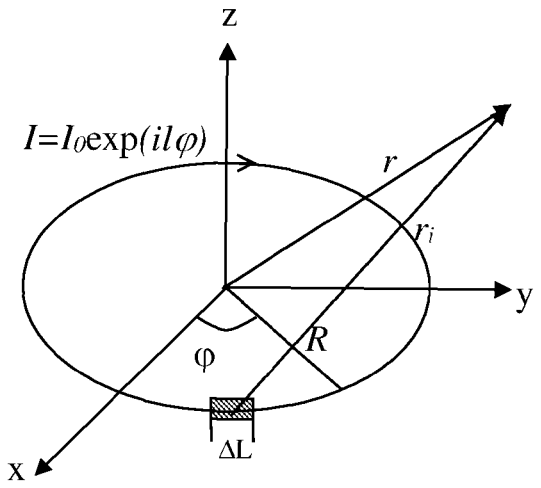
FIG. 1 is a structural sketch view of a traveling-wave loop antenna according to a first preferred embodiment of the present invention.

1. Generation Mechanism of Radio Frequency OAM Beam Based on Traveling-Wave Loop Antenna An arbitrary antenna, no matter an electric-source antenna or an magnetic-source antenna, is called a traveling-wave loop antenna as showed in FIG. 1, as long as the antenna meets the following requirements: a space distribution of the antenna is an annulus; the annulus is symmetrical around Z-axis; each point of the annulus has a uniform excitation source amplitude; a phase changes continuously along each point on the annulus and satisfies a distribution of exp(ilϕ), wherein ϕ is an azimuthal angle and l is a positive or negative integer. Through numerical electromagnetic analysis, a radiation of the traveling-wave loop antenna in free space is able to generate an l-order OAM beam with a spiral phase distribution of exp(ilϕ).

Figure 2:
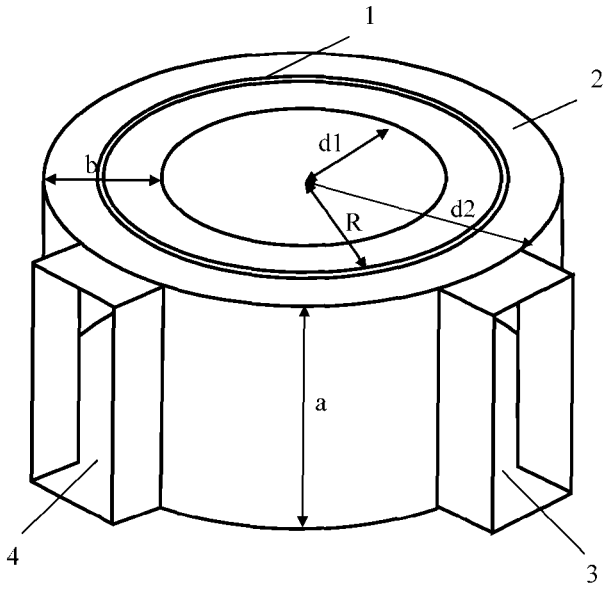
FIG. 2 is a structural sketch view of the traveling-wave loop antenna based on a metal ring cavity according to the first preferred embodiment of the present invention.

2. Verification of Traveling-Wave Loop Antenna Based on Metal Ring Cavity for Generating Radio Frequency OAM Beam FIG. 2 shows a structural sketch view of the traveling-wave loop antenna based on the metal ring cavity for generating the radio frequency OAM beam, according to a first preferred embodiment of the present invention. A main structure of the traveling-wave loop antenna is the metal ring cavity 2 whose top surface has an annular slot 1 opened. The metal ring cavity is obtained through bending a rectangular waveguide which works at a $TE_{10}$ mode. A height of a lateral surface of the metal ring cavity is a wide side a of the rectangular waveguide, and a width of the top surface of the metal ring cavity is a narrow side b of the rectangular waveguide. The annular slot is opened in the middle of the narrow side of the rectangular waveguide. A perimeter of the metal ring cavity is a longitudinal length of the rectangular waveguide. A circumferential propagation constant $k_\phi$ of the metal ring cavity is equivalent to a longitudinal propagation constant $k_z$ of the rectangular waveguide, $$k_\varphi = \sqrt{k^2 - \left(\frac{\pi}{a}\right)^2}.$$

Figure 3:
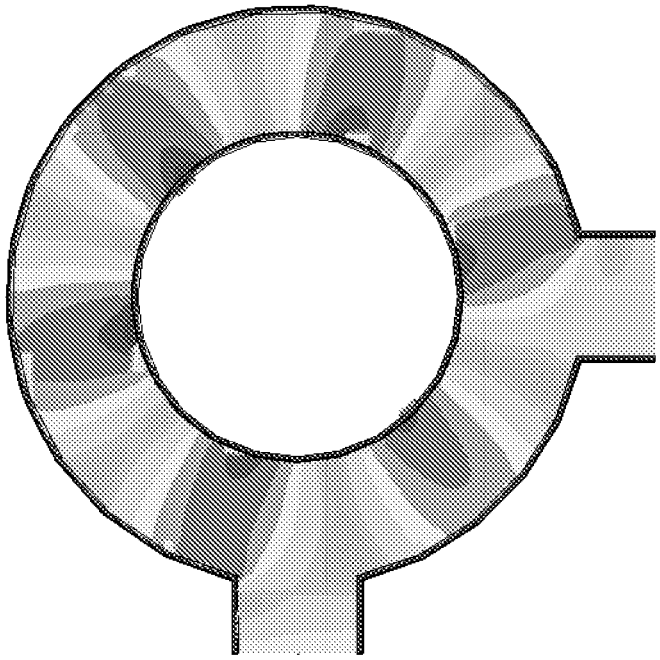
FIG. 3 is a traveling-wave distribution diagram of an electric field in the metal ring cavity when two excitation source ports of the traveling-wave loop antenna are inputted with microwave sources having the same frequency and a phase difference of 90° according to the first preferred embodiment of the present invention.
Figure 4:
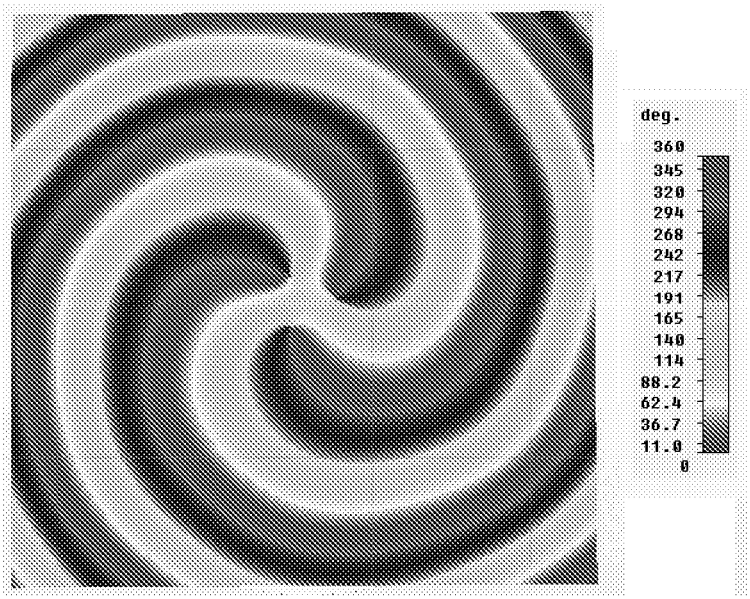
FIG. 4 is a phase distribution diagram of an electric field radiation pattern in free space of the traveling-wave loop antenna according to the first preferred embodiment of the present invention.

Two openings 3 and 4, which are ¼ of the perimeter apart with each other on the lateral surface of the metal ring cavity, are two excitation ports, for connecting a metal waveguide. When the two excitation source ports are inputted with microwave sources having the same frequency and a phase difference of ±90°, an electromagnetic field in the metal ring cavity exhibits a traveling-wave distribution propagating circumferentially clockwise or counterclockwise. FIG. 3 shows an electric field distribution in the metal ring cavity obtained by an electromagnetic simulation software Computer Simulation Technology (CST). According to the first preferred embodiment of the present invention, l=3; a radio frequency has a frequency of 10 GHz; the rectangular waveguide has the wide side a=23 mm, and the narrow side b=10 mm; the metal ring cavity has an inner radius d1=13.9 mm, and an outer radius d2=23.9 mm. An electromagnetic wave is radiated into the free space from the annular slot opened on the top surface of the metal ring cavity, thereby constituting a magnetic-source traveling-wave loop antenna. FIG. 4 shows a phase distribution diagram of an electric field radiation pattern in the free space of the traveling-wave loop antenna, obtained by the electromagnetic simulation software CST. The annular slot has a center radius R=18.9 mm, satisfying $k_\phi R=3$, and a width of 1 mm. As showed in FIG. 4, an azimuthal phase distribution of the electric field around a propagation direction axis shows a vortex property, and the change of the phase of the electric field around a single circle satisfies 2π/=6π, proving that the traveling-wave loop antenna based on the metal ring cavity generates the radio frequency OAM beam with l=3.

Figure 5:
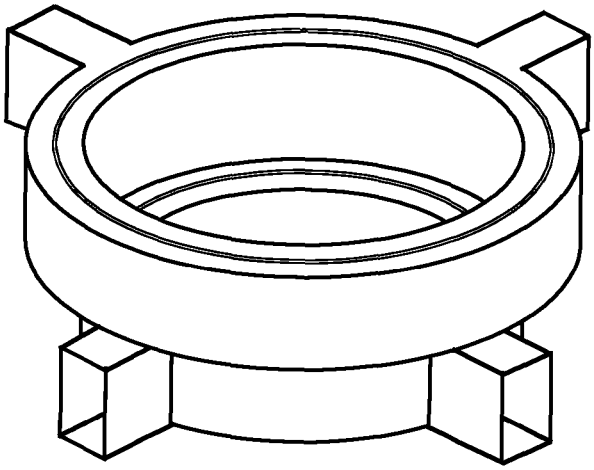
FIG. 5 is a sketch view of a first radio frequency OAM beam multiplexing device integrated by the traveling-wave loop antennas according to a second preferred embodiment of the present invention.
Figure 6:
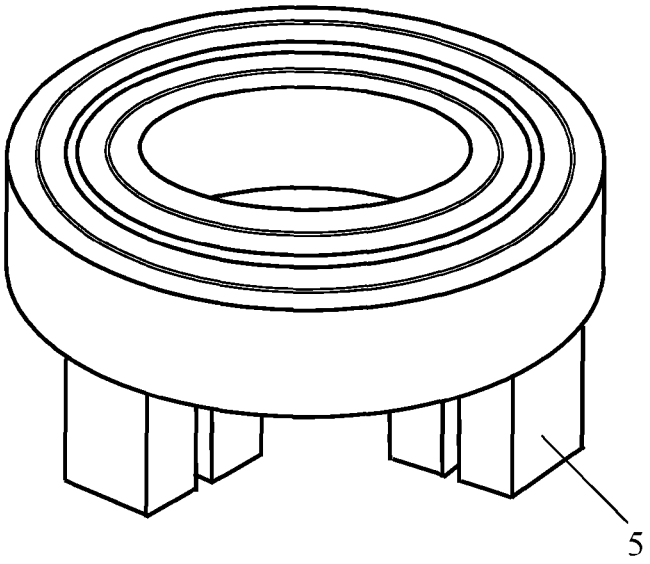
FIG. 6 is a sketch view of a second radio frequency OAM beam multiplexing device having a compact structure based on bottom-feed traveling-wave loop antennas according to a third preferred embodiment of the present invention.

3. Radio Frequency OAM Beam Multiplexing with Integrated Traveling-Wave Loop Antennas Provided by Present Invention According to the traveling-wave loop antenna based on the metal ring cavity provided by the present invention, the order l of the OAM beam is related to the height of the lateral surface of the metal ring cavity and the radius of the annular slot which are reasonably designed to satisfy $k_\phi R=l$, so as to realize a generation of the OAM beams with the different orders. According to a second preferred embodiment, through stacking a plurality of the metal ring cavities for generating the OAM beams with the different orders, as showed in FIG. 5, the OAM beams with the different orders is generated in free space, so as to realize multiplexing of the radio frequency OAM beams. FIG. 5 merely shows multiplexing of the OAM beams with two different orders l. In other embodiments, to stack a plurality of the traveling-wave loop antennas based on the metal ring cavities is able to multiplex a plurality of the OAM beams. According to a third preferred embodiment, by changing a lateral feed into a bottom feed 5, an OAM beam multiplexing device having a more compact structure is realized, wherein the plurality of the traveling-wave loop antennas based on the metal ring cavities, having the different radiuses, are sleeved with each other, as showed in FIG. 6.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A traveling-wave loop antenna based on a metal ring cavity for generating a radio frequency orbital angular momentum (OAM), comprising said metal ring cavity with an annular slot circumferentially opened on a top surface, wherein:

said metal ring cavity is obtained through bending a rectangular waveguide which works at a $TE_{10}$ mode;

a height of a lateral surface of said metal ring cavity is a wide side a of said rectangular waveguide, and a width of said top surface of said metal ring cavity is a narrow side b of said rectangular waveguide;

said annular slot is opened in the middle of said narrow side of said rectangular waveguide;

a perimeter of said metal ring cavity is a longitudinal length of said rectangular waveguide;

a circumferential propagation constant $k_\phi$ of said metal ring cavity is equivalent to a longitudinal propagation constant $k_z$ of said rectangular waveguide;

two openings, which are ¼ of said perimeter apart with each other on said lateral surface of said metal ring cavity, are two excitation source ports, for connecting a metal waveguide;

when said two excitation source ports are inputted with microwave sources having the same frequency and a phase difference of ±90°, an electromagnetic field in said metal ring cavity exhibits a traveling-wave distribution propagating circumferentially clockwise or counterclockwise;

said traveling-wave loop antenna radiates an electromagnetic wave into free space from said annular slot; and a size of said metal ring cavity is adjusted, in such a manner that said circumferential propagation constant $k_\phi$ of said metal ring cavity satisfies $k_\phi R=l$, wherein R is a radius of said annular slot and l is an integer, so that said metal ring cavity realizes a conversion from a microwave guided-wave mode to an OAM mode and a generation of an OAM beam with an order of ±l in free space; whether the l is positive or negative is determined by whether said phase difference of said two excitation source ports is +90° or −90°.

2. An OAM beam multiplexing device integrated by traveling-wave loop antennas, comprising a plurality of said traveling-wave loop antennas as recited in claim 1, wherein said plurality of said traveling-wave loop antennas are stacked coaxially, so as to generate OAM beams with different orders.

3. An OAM beam multiplexing device integrated by traveling-wave loop antennas, comprising a plurality of said traveling-wave loop antennas which are sleeved coaxially, wherein:

each traveling-wave loop antenna comprises a metal ring cavity with an annular slot circumferentially opened on a top surface;

said metal ring cavity is obtained through bending a rectangular waveguide which works at a $TE_{10}$ mode;

a height of a lateral surface of said metal ring cavity is a wide side a of said rectangular waveguide, and a width of said top surface of said metal ring cavity is a narrow side b of said rectangular waveguide;

said annular slot is opened in the middle of said narrow side of said rectangular waveguide;

a perimeter of said metal ring cavity is a longitudinal length of said rectangular waveguide;

a circumferential propagation constant $k_\phi$ of said metal ring cavity is equivalent to a longitudinal propagation constant $k_z$ of said rectangular waveguide;

two openings, which are ¼ of a circumference of said metal ring cavity apart with each other on a bottom surface of said metal ring cavity, are two excitation source ports, for connecting a metal waveguide;

when said two excitation source ports are inputted with microwave sources having the same frequency and a phase difference of ±90°, an electromagnetic field in said metal ring cavity exhibits a traveling-wave distribution propagating circumferentially clockwise or counterclockwise;

said traveling-wave loop antenna radiates an electromagnetic wave into free space from said annular slot; and a size of said metal ring cavity is adjusted, in such a manner that said circumferential propagation constant $k_\phi$ of said metal ring cavity satisfies $k_\phi R=l$, wherein R is a radius of said annular slot and l is an integer, so that said metal ring cavity realizes a conversion from a microwave guided-wave mode to an OAM mode and a generation of an OAM beam with an order of ±l in free space; whether the l is positive or negative is determined by whether said phase difference of said two excitation source ports is +90° or −90°.

* * * * *